United States Patent [19]

Stotts

[11] Patent Number: 4,601,171

[45] Date of Patent: Jul. 22, 1986

[54] CONTROL APPARATUS FOR HOT GAS ENGINE

[75] Inventor: Robert E. Stotts, Clifton Park, N.Y.

[73] Assignee: Mechanical Technology Incorporated, Latham, N.Y.

[21] Appl. No.: 762,575

[22] Filed: Aug. 5, 1985

[51] Int. Cl.[4] ..... F02G 1/06

[52] U.S. Cl. ..... 60/521; 60/517; 60/525

[58] Field of Search ..... 60/517, 521, 522, 525

[56] References Cited

U.S. PATENT DOCUMENTS

| | | | |
|---|---|---|---|
| 3,827,241 | 8/1974 | Almstrom et al. | 60/521 |
| 3,990,246 | 11/1976 | Wilmers | 60/521 X |
| 4,483,142 | 11/1984 | Tsunekawa et al. | 60/521 |

*Primary Examiner*—Stephen F. Husar

*Attorney, Agent, or Firm*—Joseph V. Claeys; Charles W. Helzer

[57] ABSTRACT

A mean pressure power control system for a hot gas (Stirling) engine utilizing a plurality of supply tanks for storing a working gas at different pressures. During pump down operations gas is bled from the engine by a compressor having a plurality of independent pumping volumes. In one embodiment of the invention, a bypass control valve system allows one or more of the compressor volumes to be connected to the storage tanks. By selectively sequencing the bypass valves, a capacity range can be developed over the compressor that allows for lower engine idle pressures and more rapid pump down rates.

19 Claims, 8 Drawing Figures

CONTROL APPARATUS FOR HOT GAS ENGINE

The Government of the United States of America has rights in this invention pursuant to contract No. DEN 3-32 awarded by the United States Department of Energy.

BACKGROUND OF THE INVENTION

This invention relates to a hot gas engine and, in particular, to controlling the operation of a Stirling engine suitable for use in an automotive application.

The Stirling or hot gas engine cycle is well known in the art. A two cylinder engine is described in U.S. Pat. Nos. 3,984,983 and 3,999,388 while the operation of a four cylinder engine is further described in U.S. Pat. Nos. 3,914,940 and 4,474,003. The Stirling engine is durable, clean burning and exhibits relatively high efficiency when compared to the more conventional internal combustion engine. The Stirling engine, however, is relatively slow to respond to changes in power demands and thus difficult to adapt for use in motor vehicles where engine acceleration and deceleration must be rapid. Recently efforts have been undertaken to improve the response time of the Stirling engine so that it might be better adapted to use in motor vehicles.

In the hot gas engine, the engine power output is regulated by changing the pressure of a working gas, such as helium or hydrogen, contained within the engine. To increase the engine's output power, the internal gas pressure is increased by adding gas to the engine from an external supply reservoir. To decrease the engine pressure, gas is typically pumped from the engine back to the supply reservoir using a compressor.

Single acting or double acting compressors are generally used to pump down the hot gas engine. In either case, the compressor has a single capacity. In order to attain a satisfactory idle pressure, which is usually about four megapascals, the capacity of the single capacity compressor must be relatively low. As a consequence, the pump down rate of the engine is correspondingly slow and the time required to bring the engine pressure from some high operating value to idle is longer than desired particularly when the engine is employed in an automotive application. That portion of the engine gas that cannot be pumped by the limited capacity compressor is short circuited back to the engine. The energy contained in the short circuited gas is dissipated in the engine and represents lost power thereby reducing engine efficiency. This type of efficiency penalty can be relatively large and can only be minimized by increasing the pump down rate.

In U.S. Pat. No. 3,782,119 there is disclosed a hot gas engine employing the Stirling power cycle in which the compressor is replaced by a series of supply tanks. The tanks are maintained at different pressures and, through use of a control valve, one or more of the tanks can be connected to the engine to raise the engine pressure to some desired level. During pressure reduction, engine gas is bled back into tanks again by selectively sequencing the control valves. The valving scheme, by necessity, must be rather complex and maintaining close control over the tank pressures is sometimes difficult. The response of the engine without the aid of a compressor is relatively slow.

SUMMARY OF THE INVENTION

It is therefore an object of the present invention to improve hot gas engines.

A further object of the present invention is to improve the response of a hot gas engine to changes in power demands.

A still further object of the present invention is to increase the pump down rate of a hot gas engine.

Another object of the present invention is to reduce the idle pressure in a hot gas engine while at the same time increasing the capacity of the pump down compressor.

Yet another object of the present invention is to improve the operating efficiency of a hot gas engine by reducing the amount of energy lost in the form of waste heat.

Yet a further object of the present invention is to combine the use of a multiple supply tank reservoir and a multiple capacity compressor in a hot gas engine to improve the response and efficiency of the engine.

These and other objects of the present invention are attained in a hot gas engine by providing the engine with a multi-tank reservoir for supplying gas to the engine and a multi-volume compressor for pumping gas from the engine back to the supply tanks. The suction side of the compressor is arranged to draw working gas from the engine and deliver it to a number of compressors each of which has a different volumetric capacity. The discharge line of each compressor is connected to a common return line leading back to the supply tanks. The operation of the compressors is controlled so that the individual capacities can be selectively combined to provide a plurality of different output capacities depending upon the number of compressors involved. The combined capacity of the compressors is closely matched to the needs of the engine as engine conditions change to increase the pump down rate and raise the engine efficiency.

In one embodiment of the invention a multi-capacity compressor is driven directly from the engine and has three different sized compression chambers that are adapted through use of valve actuated loops to provide seven separate capacities. The supply reservoir contains two tanks that are maintained at different pressures wherein the pressure in the high pressure tank is about equal to the maximum engine design pressure and in the low pressure tank is maintained about equal to one half the maximum engine design pressure. The tanks are selected by means of control valves that are sequenced in response to sensed engine conditions.

BRIEF DESCRIPTION OF THE DRAWINGS

For a better understanding of these and other objects of the present invention reference is had to the following detailed description of the invention which is to be read in conjunction with the accompanying drawings wherein.

DESCRIPTION OF THE INVENTION

Figure 1:
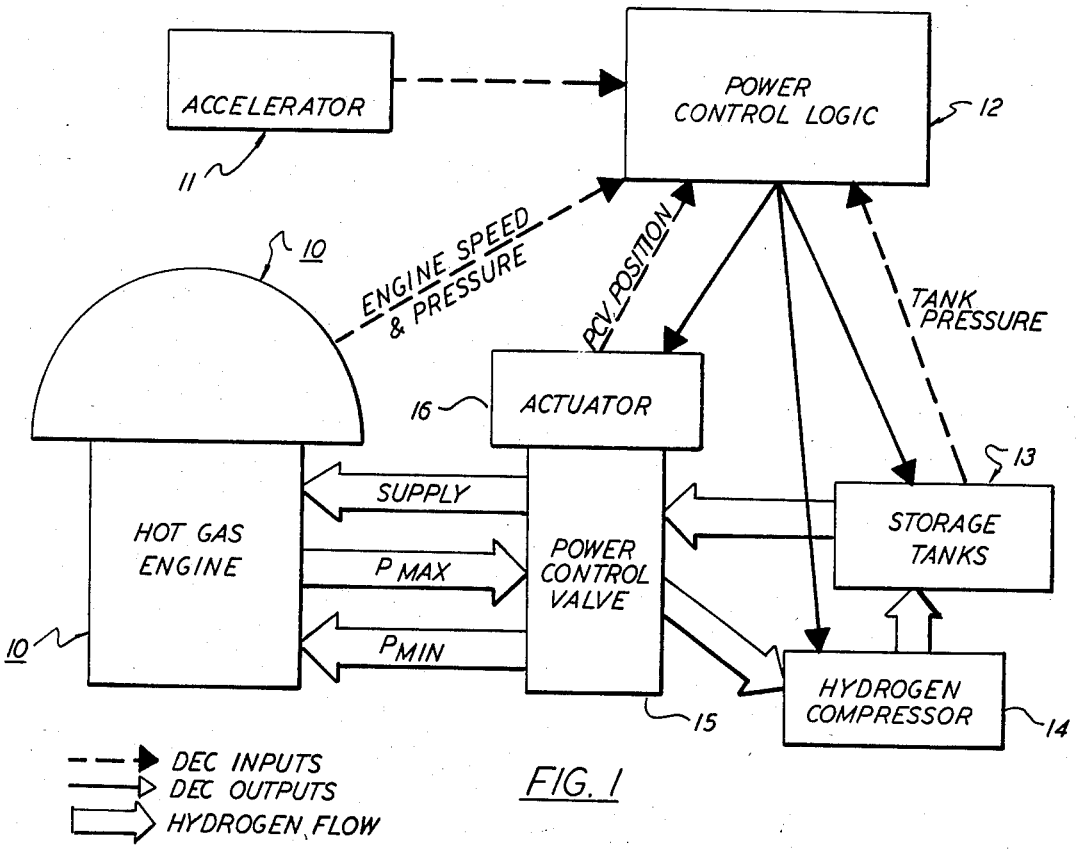
FIG. 1 is a diagram showing a hot gas engine including a generalized mean pressure control system embodying the teachings of the present invention.

Turning initially to FIG. 1, there is shown a diagram of a hot gas engine 10 of conventional and well known design utilizing the Stirling power cycle to develop usable output power. Accompanying the engine is a mean pressure control system which, in conjunction with the engine, embodies the teachings of the present invention. As will become apparent from the disclosure below, the present system has wide application in the automotive field because of, among other things, its rapid response to changes in accelerator settings and its ability to idle at pressures that are considerably lower than normally attainable in the art.

A selectively positionable accelerator 11 is employed to change the output power delivered by the engine. Although not shown, a potentiometer is operatively associated with the accelerator that is adapted to send an output signal to the control logic unit 12, the function of which will be explained in greater detail below. The control logic unit is arranged to receive data from different sources relating to the various operating conditions and send instruction in response to the information to control the flow of working gas through the system.

One control unit involves the power control valve 15 (PCV) which regulates the addition and removal of working gas from the engine 10. The positioning of the valve is regulated by an electrical actuator 16.

Figure 5:
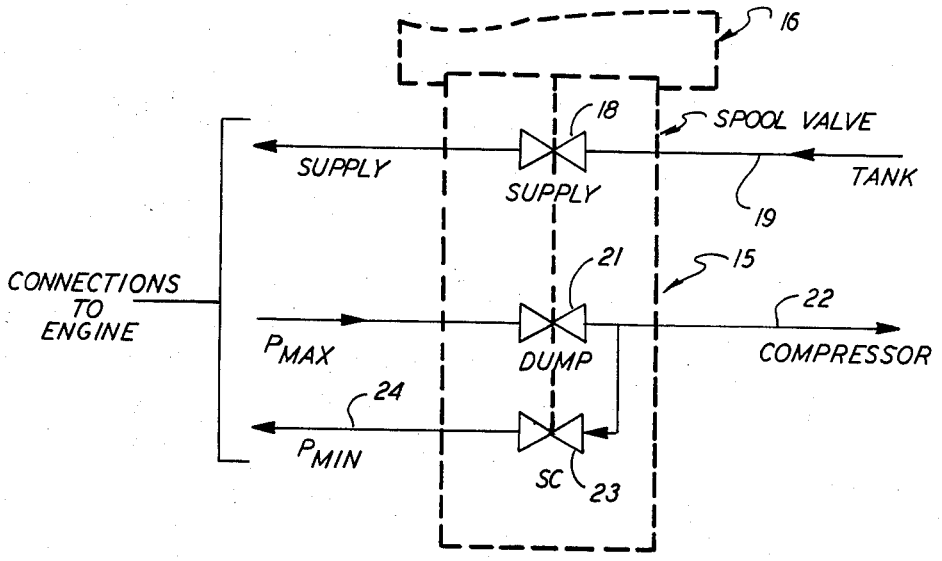
FIG. 5 is a schematic diagram showing the operation of the power control valve used in the practice of the invention.

Both the control valve 15 and actuator 16 are known and used in the art to control the flow of a working gas into and out of the engine. The valve is of a well known sliding spool design having a series of inlet and outlet ports that can be opened and closed in an ordered sequence as the spool is advanced or retracted by the actuator. The valve, as schematically shown in FIG. 5, is designed to provide three proportional control functions. First it is adapted to allow gas to be admitted to the engine from a multiple tank supply reservoir unit 13 via line 19 when porting valve 18 is opened. This raises the engine pressure and thus increases the power output of the engine. Secondly, to reduce engine power, porting valve 21 is opened thus permitting working gas to be pumped from the engine via line 22. Line 22 is connected to the suction side of a compressor unit which serves to pump down the engine and return the gas to the supply tanks when reduced power is called for. Lastly, a short circuiting porting valve 23 is provided which is opened when the compressor is unable to meet the pump down demands of the accelerator. The short circuited gas is returned to the cool side of the engine at reduced pressure to decrease the available engine power.

Engine parameters concerning engine speed and engine pressure are sent from engine 10 to the logic circuitry as indicated by the arrows in FIG. 1. Data relating to the PCV setting and the supply reservoir pressure are also provided to the logic circuitry. Changes in accelerator positions are sent to the logic circuits which analyze this information in relation to the sensed parameters and, in response thereto, sends control signals to the PCV, the supply reservoir unit and the pump down compressor to regulate the movement of the working gas into and out of the engine.

Figure 2:
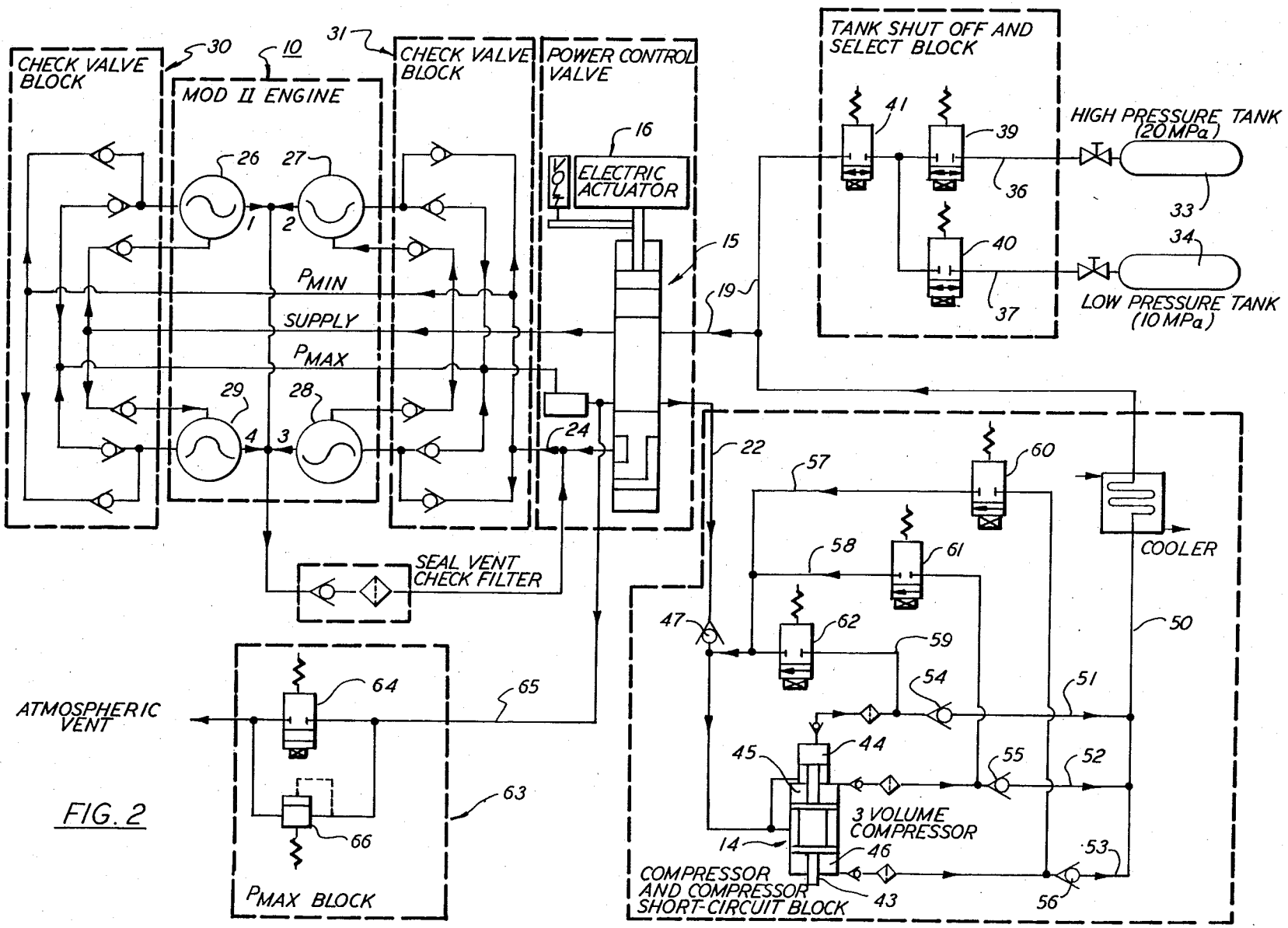
FIG. 2 is a representation in block diagram form showing the mean pressure control system of the present invention in greater detail.

Turning now to FIG. 2, there is illustrated in greater detail the pressure control system utilized in the present invention. The hot gas engine 10 utilizes four cylinders 26 ∝ 29 that are interconnected in a well known manner by flow passages for exchanging gas between the low temperature side of one cylinder with the high temperature side of an adjacent cylinder. Although not shown, a cooler, a regenerator and a heater are mounted along the flow paths to heat and cool working gas as it is exchanged between cylinders. The engine contains a pair of check valve units 30 and 31 which control the flow of working gas as it moves through the engine in response to the positioning of the power control valve 15. The power output of the engine is controlled by adjusting the pressure of the working gas within the engine. The operation of a four cylinder engine of this type is more thoroughly described in previously noted U.S. Pat. Nos. 3,914,940 and 4,474,003.

Gas is supplied to the engine from the supply reservoir 13. The reservoir contains two supply tanks, a high pressure tank 33 and a low pressure tank 34. The tanks are connected to the engine supply line 19 (FIG. 5) via feeder lines 36 and 37. A solenoid actuated control valve 39 is operatively connected into line 36 while a second solenoid actuated control valve 40 is operatively connected into line 37. A third solenoid actuated shutoff valve 41 is positioned downstream in the supply line 19. Control valves 39 and 40 are arranged so that they can be controlled remotely to selectively connect one of the tanks in the multi-tank reservoir to the engine supply line. At engine shut-down, all valves 39–41 are moved to a closed position to insure that no gas escapes from the tanks when the engine is idle. The shut-off valve 41 is opened at start-up and will remain open until the engine is again shut down.

The gas storage tanks are maintained at two different pressures. A high pressure about equal to the maximum engine pressure is maintained in tank 33 while a pressure of about one half the maximum engine pressure is maintained in tank 34. During addition of gas to the engine, the low pressure tank initially supplies working gas until such time as the engine pressure nears or equals the tank pressure. At this time, solenoid control valves 39 and 40 are operationally switched and further gas is added from the second higher pressure tank. During pump down, when engine power is being reduced, gas is pumped out of the engine by the compressor 14 and returned to a selected one of the two tanks. In the event the maximum engine pressure at the start of pump down is greater than the pressure in the low pressure tank, the control valves are sequenced to return the gas to the high pressure tank first. The valve settings are changed when the desired pressure in tank 33 is reached whereupon the remaining gas is pumped from the engine to low pressure tank 34.

Compressor 14 contains three compression chambers 44–46 each of which contains a movable piston that is driven from a common rod 43. Although not shown, the rod is connected directly to the engine and arranged to drive the pistons at some fixed ratio to engine speed. Each chamber has a different volume to in effect provide three independent compressors.

Working gas from the engine is delivered to the suction side of the compressor via suction line 22. A check valve 47 is positioned in the suction line to prevent gas from flowing from the compressor back to the engine. The compressor chambers 44–46 are connected at the high pressure or discharge side thereof to a return line 50 via three discharge lines 51–53. Check valves 54–56 are placed in the discharge lines as shown to allow the discharge gas to move in one direction only from the compressor to the return line. Bypass lines 57–59 are connected into the three discharge lines immediately before the check valves in the direction of discharge flow. The bypass lines function to provide a return loop in each discharge circuit by which gas discharged from the compressor can be brought back to the suction line behind check valve 47.

Solenoid actuated control valves 60–62 are positioned in each of the bypass lines 57–59 as illustrated in FIG. 2. The control valves can be remotely operated to selectively open and close each bypass loop. By selectively positioning the valves, seven different compressor capacities can be obtained without changing the speed of the compressor. Opening all the bypass control valves 60–62 will redirect all discharge gas back to the suction side of the compressor whereby no gas will be delivered to the tank return line 50. The capacity of the compressor can thus be adjusted to keep the compressor power requirements equal to or less than the power available to drive the compressor. In practice, the chamber volumes are sized so that the capacity of the smallest chamber is matched to the desired engine idle pressure. The combined output of three chambers is selected to match the maximum desired pump down for the engine. Inbetween the maximum and minimum engine values, the capacity of the compressor can be varied to meet changing pump down requirements. The fuel economy of the engine can thus be maximized by stepping the capacity of the compressor in response to the power available to drive the compressor.

An atmospheric venting system 63 is connected into the high pressure section of the engine to automatically vent working gases to atmosphere in the event engine pressures exceed the desired maximum design pressure. The venting system includes a solenoid actuated relief valve 64 that can be manually actuated by the operator in the event of an emergency to dump high pressure working gas directly to atmosphere via emergency dump line 65. The valve 64 is bypassed by an automatic pressure relief valve 66 which is adapted to sense the actual engine pressure and automatically open if the pressure exceeds a predetermined safe value.

Figure 3:
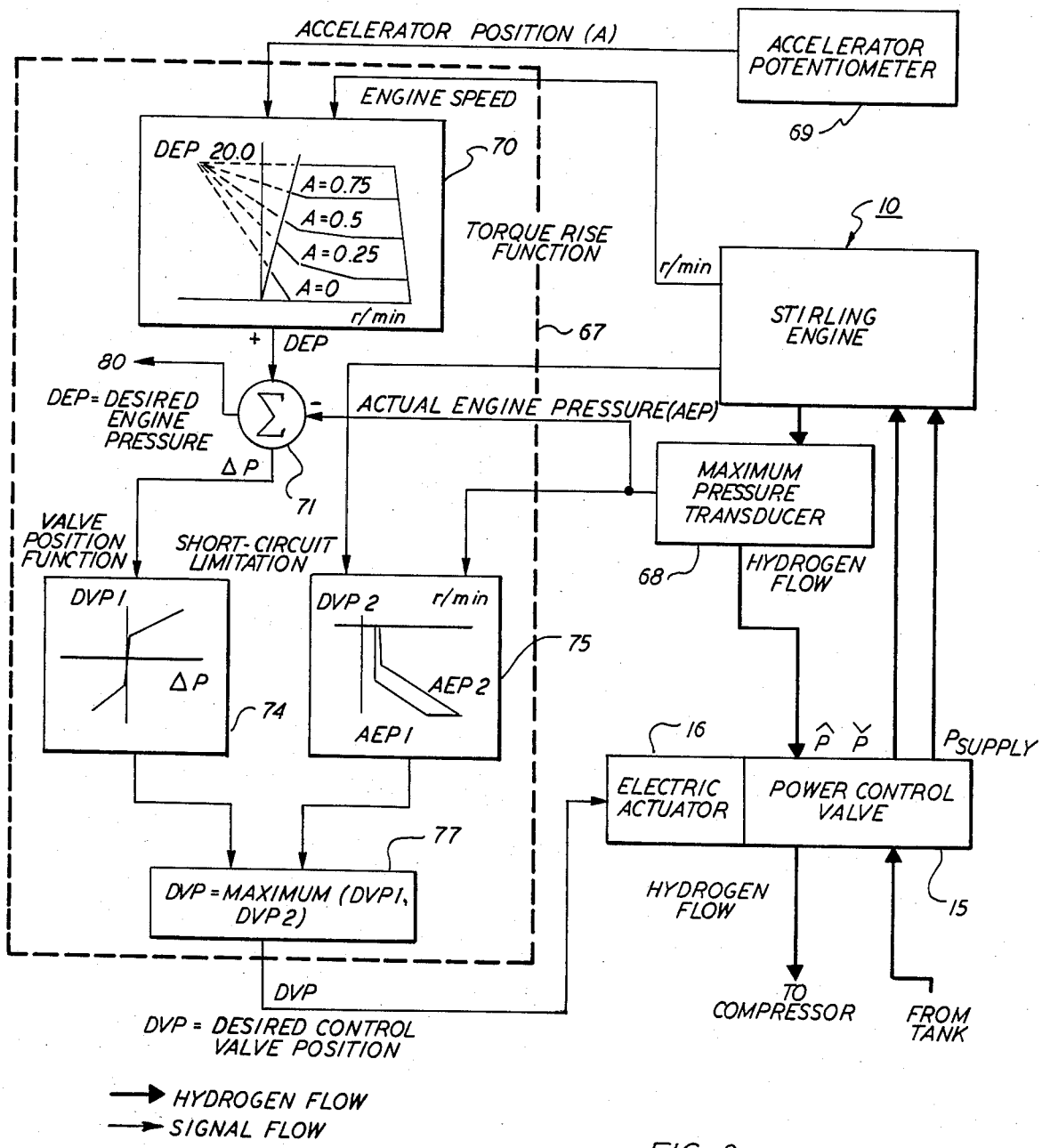
FIG. 3 is a diagram showing the mean pressure control valve logic used in the practice of the present invention.

The engine pressure is controlled by use of the noted power control valve 15 and actuator 16 acting in conjunction with the pressure mapping logic circuitry 67 shown in FIG. 3. As previously noted, the engine 10 is arranged to act in response to the valve 15 to admit or release working gas to the engine to increase or decrease engine output power. Working gas is added from one of the two supply tanks and is discharged to the suction side of the compressor as explained above by sequencing the appropriate control valves. The engine contains a pressure transducer 68 in the high pressure section thereof that is adapted to monitor engine pressure and provide an output signal indicative thereof. Engine speed is also monitored by a tachometer (not shown) and a second signal indicative of engine speed (rpm) is also provided to the logic circuits.

A potentiometer 69 is operatively associated with the accelerator that senses the accelerator's position and applies a demand signal to torque rise logic circuit 70. This logic circuit is programmed to compare the engine speed to the accelerator setting and determine the desired engine pressure needed to meet the accelerator's demand. A desired engine pressure data signal is sent from the torque rise logic circuit to a differential amplifier 71 which compares the two inputs and produces an output signal that is indicative of the difference between the two pressures ($\Delta P$). The differential signal is applied to valve position logic circuit 74 that is programmed to determine the optimum power control valve (PCV) position to meet the accelerator's demand. A short circuit logic unit 75 also receives data from the engine pressure transducer 68 and the engine tachometer. The logic unit is programmed to determine the short circuit limitations during pump down based on these two inputs and provides a data input signal to controller 77 indicative of this limitation. The controller 77 also receives a second input from the valve position function logic. The controller evaluates the two inputs and, in response thereto, instructs the valve actuator 16 to position the PCV to an optimum position to meet accelerator demands.

Figure 4:
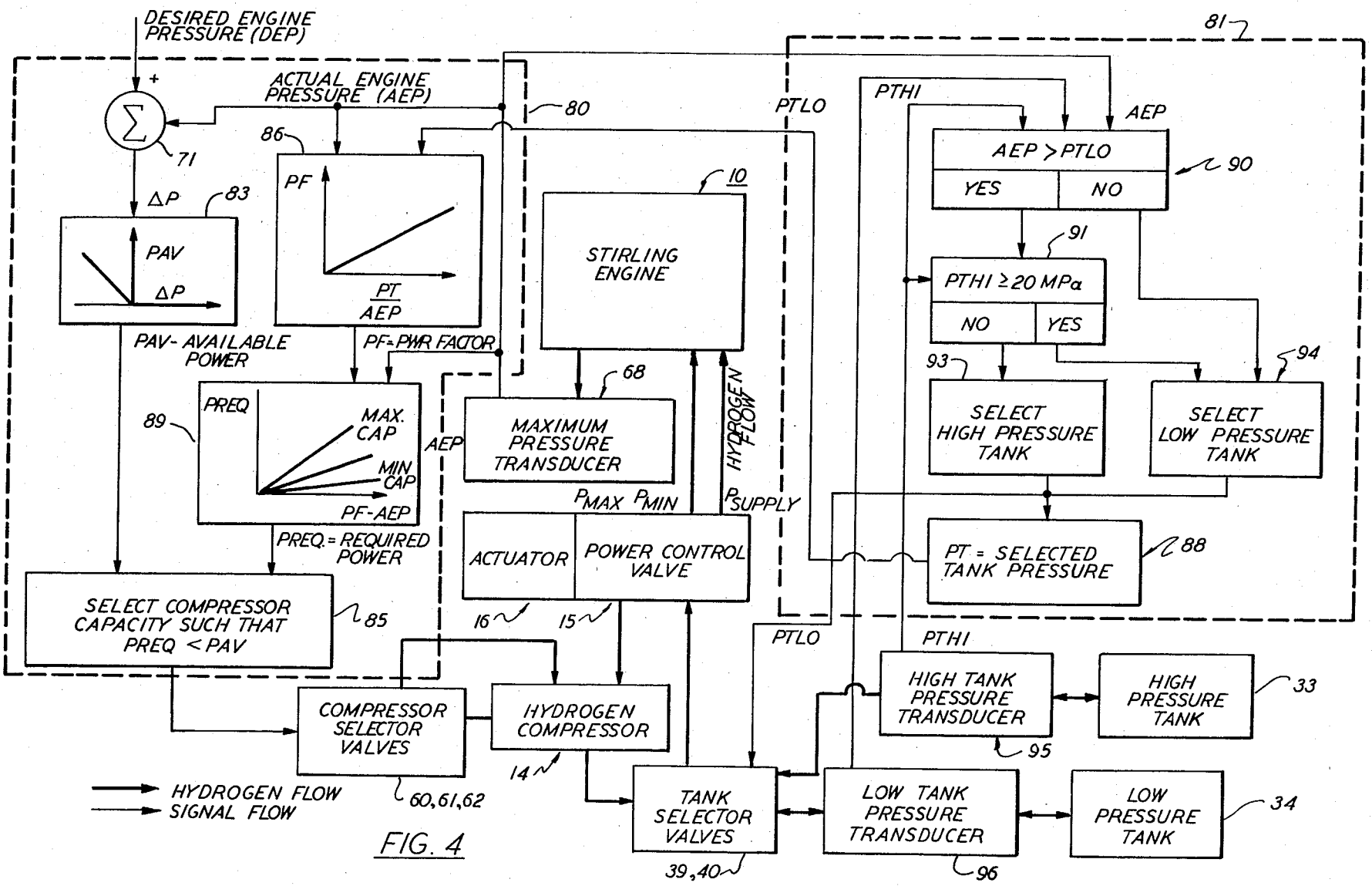
FIG. 4 is a diagram showing the compressor and supply tank selection logic employed in the practice of the present invention.

Sequencing of the compressor and supply bottle control valves is provided by the logic circuitry illustrated in FIG. 4. The compressor selection logic unit is shown at block 80 while the tank selection logic unit is similarly shown at block 81. The previously noted engine pressure transducer 68 is again utilized to provide actual engine pressure data. This data is forwarded to both the compressor selector logic block 80 and the tank selector logic block 81.

In the compressor selector logic block, the actual engine pressure data is once again related to the desired engine pressure by differential amplifier 71 to determine the difference between the two pressures. This data ($\Delta P$) is applied to available power logic circuit 83 which is programmed to determine the amount of power available from the engine to drive the compressor during pump down operations. The power available information is forwarded to compressor bypass valve selector logic circuit 85. The compressor selector logic unit includes a power factor logic circuit 86 programmed to provide a power factor output signal. This power factor signal is a function of the ratio of tank pressure to engine pressure. The actual tank pressure data signal, as will be explained below, is generated by a tank pressure monitoring circuit 88 found in tank selector logic block 81. The power factor output signal is applied to required pressure logic circuit 89 where it is multiplied with the actual engine pressure signal provided by power transducer 68. The power required logic is programmed to provide an output signal based on these two inputs to bypass valve controller 85. This output signal is indicative of the amount of power that is required to drive the compressor at each of the available capacities. The controller evaluates the input data and selects a capacity whereby the required compressor power needed for that capacity is less than the power available from the engine. Control signals to attain the selected capacity are sent to the control valves 60–62.

Turning now to the tank selector logic block 81, there is illustrated a logic flow diagram of the tank selection scheme which is coordinated with the compressor control logic through previously noted tank pressure monitoring circuit 88. As will be explained in greater detail below, the tank selector logic is arranged to monitor the pressures in the tanks and also sequences the tank selector valves 39 and 40 in response to the pressures involved.

A first pressure transducer 95 is operatively connected to the output of the high pressure tank 33 while a second pressure transducer 96 is similarly attached to the output of the low pressure tank 34. The transducers each produce an independent output signal which is indicative of the pressure in the monitored tank. The signals are applied along with the pressure signal from the engine pressure transducer 68 to input logic circuit 90 shown in FIG. 4. Here the three inputs are evaluated to determine if the actual engine pressure is greater than the pressure in the low pressure tank 34. If it is, an enabling signal is sent to maximum pressure logic circuit 91. If it is not, an enabling signal is sent to the low pressure tank selector circuit 94.

The maximum pressure logic circuit, when enabled, will send a signal to the high pressure tank selector circuit 93 which is adapted to sequence the tank control valves 39 and 40 so that the high pressure tank is placed on the line to either add gas to the engine or accept gas from the compressor discharge. When the tank 33 has reached maximum capacity, an override signal is sent to the low pressure tank selector circuit 94. The low pressure tank selector circuit, when enabled from either logic circuit 90 or 91, will sequence the control valves 39 and 40 to take the high pressure tank off line and replace it with the low pressure tank.

Figure 7:
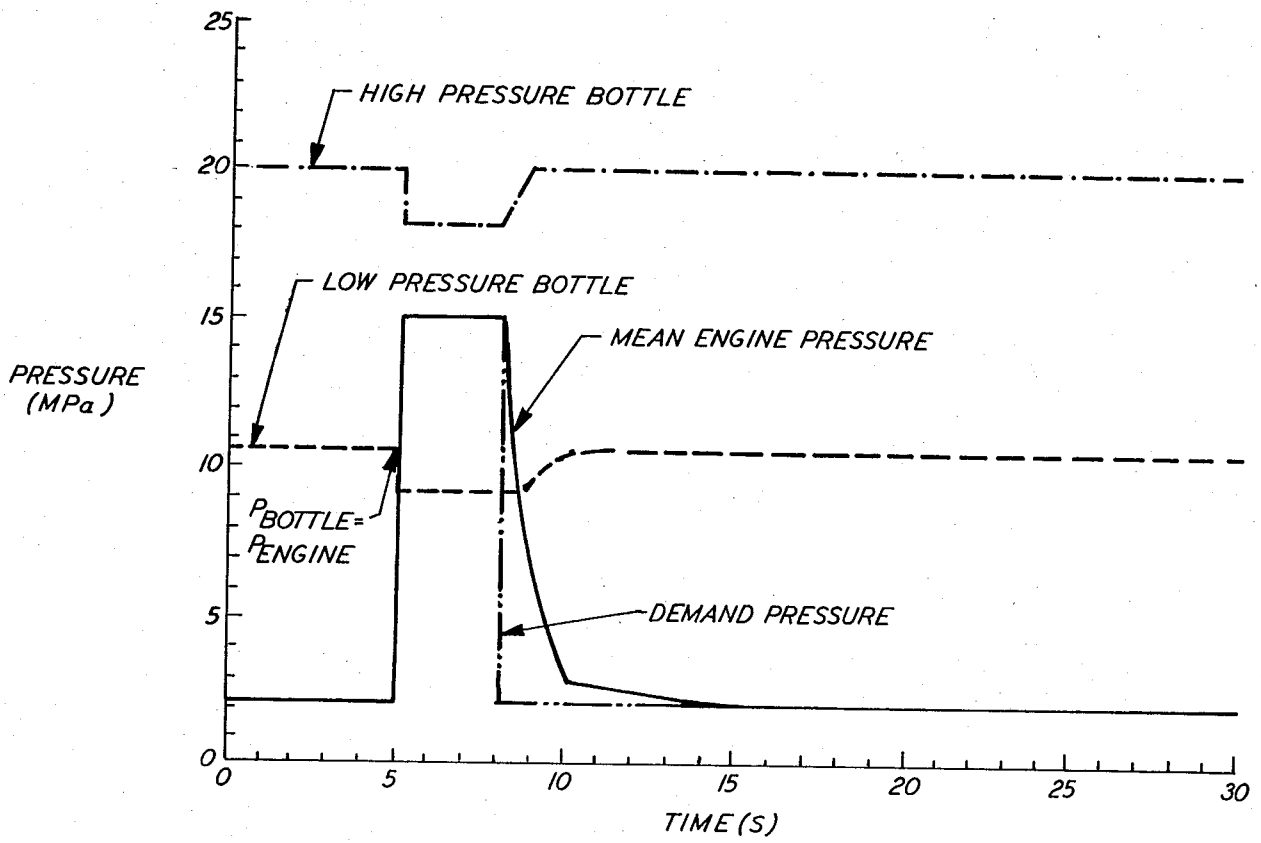
FIG. 7 is a graphic representation comparing engine pressure and storage tank pressure plotted against time.

The operation of the supply bottles is depicted graphically at FIG. 7 wherein various operational pressures associated with the present system are shown plotted against time. In this embodiment of the invention the maximum allowable pressure in the high pressure bottle is maintained at 20 megapascals (MPa) while the maximum allowable pressure in the low pressure bottle is 10 MPa. Through use of the three volume compressor, the engine is able to idle at about 2 MPa which is approximately half the idle pressure attainable in a single volume compressor system. At about the five second mark, the accelerator is advanced to call for an operating pressure somewhere around 15 MPa. With both tanks full, working gas is fed from the low pressure tank until the engine pressure equals the tank pressure. At this time the tanks are switched and further gas is added from the high pressure tank until the accelerator demand is met. The engine pressure will remain constant until such time as the accelerator setting is moved back toward idle or further advanced.

In the present example, the accelerator is brought back to idle at about the eight second mark whereby the demand pressure is returned to idle pressure. The engine pressure, however, cannot immediately follow the demand pressure line because the compressor must pump down the engine which takes some finite amount of time. However, using the compressor and tank selector scheme shown in FIG. 4, the compressor valves are set so that the compressor capacity is reduced in stages to more efficiently utilize the available engine power and to considerably increase the pump down rate. Initially, a maximum volume output is selected. As the engine pressure is decreasing the high pressure tank pressure is increasing. Here again, during pump down, the tanks are switched when the high pressure bottle is filled. The engine pressure continues to drop again as the pressure in the low pressure bottle increases so that when the designed idle pressure is reached the desired tank pressures have also been reached.

It should be obvious that as the pump down operation continues down from 15 MPa to 2 MPa, the capacity of the compressor will be stepped down a number of times in response to the logic program. Accordingly, the amount of power drawn from the engine to drive the compressor is minimized. This allows for the use of a larger compressor while still being able to attain lower idle pressures. A larger compressor capacitor serves to reduce the differential between desired and actual engine pressures over the operating range of the engine.

Figure 6:
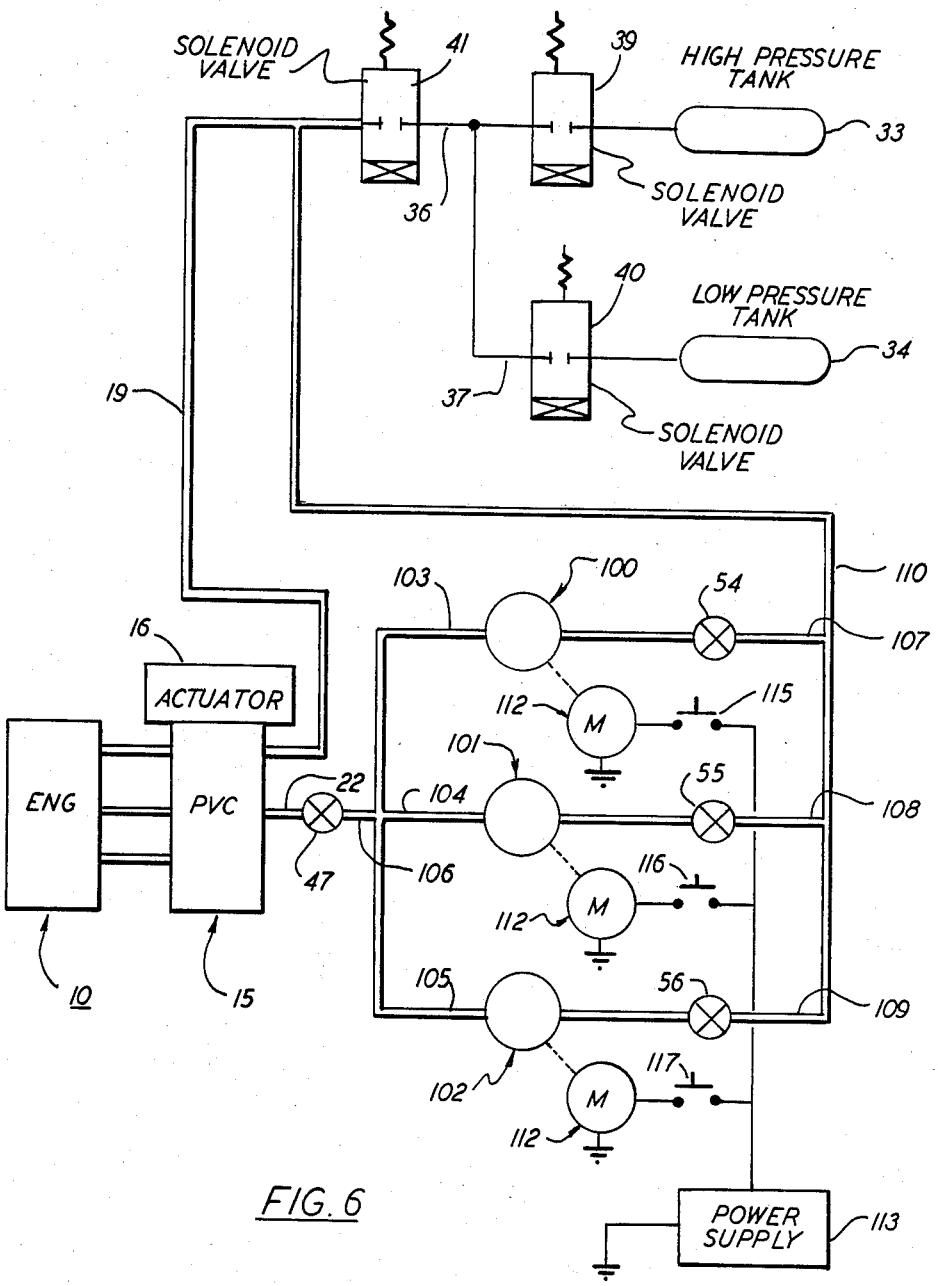
FIG. 6 is an alternate compressor arrangement suitable for use in the practice of the present invention wherein a number of individually powered compressors are employed to pump down the engine.

Turning now to FIG. 6 there is shown a second embodiment of a compressor section suitable for use in the practice of the present invention. Here again engine pressure is regulated by means of the power control valve 15 acting in response to the actuator 16. Gas is delivered to the engine from a selected one of the supply tanks 33 and 34 in response to the positioning of valves 39,40. The pump down side of the system in this embodiment contains three individual compressors 100, 101 and 102 each of which has a different capacity. The inlet lines 103–105 to the compressors are connected to a common suction line 106 through which engine gas flows during pump down. The outlet of each compressor is fed to a common return line 110 via discharge lines 107–109.

The compressors are each driven by individual motors 112—112 that are powered from a common power supply 113. Control over the compressors is maintained by switches 115–117 that can be activated remotely through the logic control circuits. The switches can be opened and closed in various combinations to again provide seven individual capacity selections. In this arrangement, the power requirements are isolated from the power available at the engine and closer matching of the compressor output to the needs of the system can be attained with a simpler logic program. The arrangement can be employed in a stationary application such as a factory where a secondary source of cheap power is available to drive the compressors.

Figure 8:
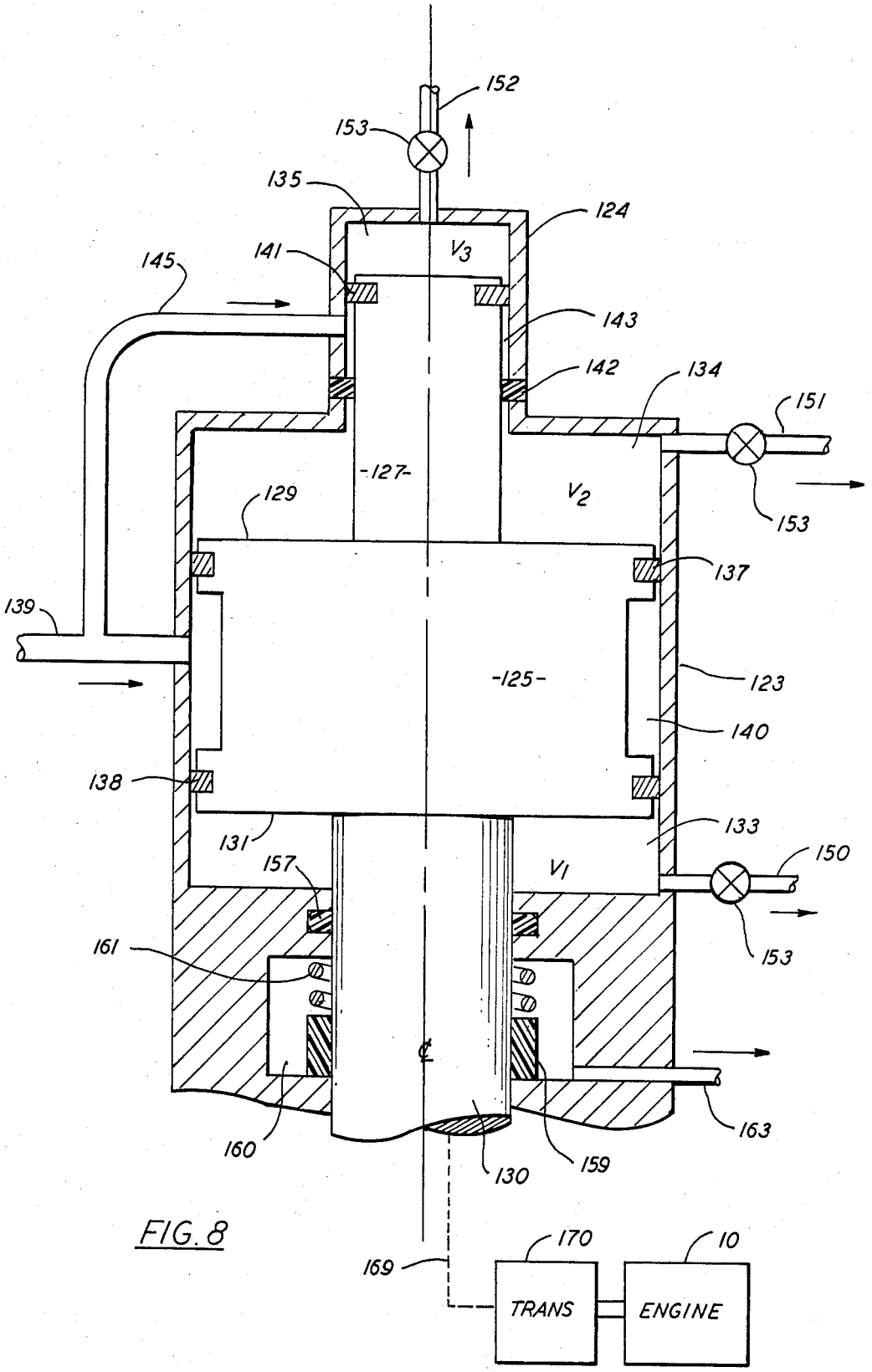
FIG. 8 is a side elevation showing a three volume compressor embodying the teachings of the invention.

Turning now to FIG. 8, there is shown a three volume compressor generally referenced 120, suitable for use in conjunction with a hot gas engine. The compressor includes a casing 121 containing a first larger cylinder 123 and a second smaller cylinder 124. A main piston 125 is housed within cylinder 123 while a smaller diameter piston 127 is housed in cylinder 124. The smaller piston is secured by any suitable means to the top surface 129 of the larger piston so that the two pistons move in unison within the respective cylinders. A drive rod 130 is affixed to the bottom portion 131 of the larger piston and is arranged to reciprocate both pistons within the cylinders. Although not shown, the rod is operatively attached to the engine by any suitable mechanism as known and used in the art to drive the compressor at some speed equal to or proportional to engine speed.

The compressor has three separate compression chambers 133–135, each of which has a different volume. It should be pointed out that the diameter of the rod 130 is greater than the diameter of the smaller piston 124 and as a result the overall volume of chamber 133 is less than that of chamber 134.

The larger piston 125 is equipped with an upper check valve ring 137 and a lower check valve ring 138 that are arranged to ride in sliding contact against the inside wall of cylinder 123. The working gas is delivered from the engine via suction line 139 into a holding region 140 formed in the piston between the check valve rings. The rings are designed to admit working gas from the holding area into the volumes on the expansion side of the piston stroke so that the volumes will be filled when the piston is bottomed in the respective chamber. On the compression side of the stroke the rings form a tight seal against the cylinder wall and prevent the gas from escaping from the chamber as it is being compressed. As can be seen, gas is being compressed on one side of piston 125 while it is being expanded on the opposite side of the piston.

The smaller piston is also provided with a check valve ring 141 that acts in conjunction with a rod seal 142 to establish a holding region 143 between the piston and cylinder 124. Gas from the engine is admitted into this region via auxiliary suction line 145. Here again, the check valve ring 141 functions to admit gas into the chamber 135 as it is being expanded and to seal the chamber as the gas therein is being compressed.

Discharge lines 150–152 are connected into the chambers 133–135, respectively, and serve to carry the high pressure gas from the compressor to the tank supply line. Each line contains a check valve 153 which prevents gas from flowing back from the discharge line to the compressor. Although not shown, relief valves may also be positioned at the discharge ports which open automatically during the compressor cycle to release high pressure gas into the lines. Each discharge line, as described above, includes a bypass loop containing a control valve that can be remotely positioned to bring discharge gases back to the suction line 139. As explained previously, the loops can be used to isolate selected chambers from the supply line so that the capacity of the compressor may be selectively varied without changing its speed. With the present three chamber arrangement, seven capacities can be attained. Similarly, by opening all the bypass loops, the compressor discharge into the supply line can be completely shut down without taking the compressor off the line. This latter setting is desirable under certain operating conditions.

A lower rod seal 157 is mounted in the lower port of the compressor casing and acts against the rod to seal the chamber 133. Immediately below the lower rod seal is the main shaft seal 159 that is housed in space 160 to further seal the compressor against leakage. The main seal is held in place by means of a spring retainer 161 as shown. The main seal is thus isolated from the compressor. The main seal housing 160 is vented to a low pressure area (not shown) at the minimum cycle pressure.

In this arrangement of the compressor the smallest volume 135 is matched to the desired idle pressure of the engine so that the chamber when selected alone will be able to pump the engine down to relatively low pressure, that is pressures not attainable by a single capacity compressor. The combined volumes of the three chambers 133–135 are likewise matched to the maximum design pressure for the engine. Selecting all three volumes provides sufficient capacity to pump the engine down rapidly when it is operating at maximum pressure. Between these two values five additional capacities can be selected. The previously noted logic circuitry is programmed to select these intermediate capacities in response to actual operating conditions so that the engine can be rapidly pumped down through the range while using a minimum amount of power from the engine. This, of course, is reflected in a more rapid engine response and a minimizing of power loss.

As further illustrated by the dotted line 169 in FIG. 8, the piston rod 130 is coupled to a mechanical driver 170 that is driven directly from the hot gas engine 10. The driver can be directly coupled to the engine to move the rod at about engine speed or might, alternatively, involve a gear box or similar type transmission for driving the compressor at ratio of engine speed.

While this invention has been described with reference to the structure disclosed herein, it is not confined to the details set forth and this application is intended to cover any modifications or changes as may come within the scope of the following claims.

I claim:

1. Apparatus for controlling the operation of a hot gas engine that includes a hot gas engine having a positionable power controller for adding working gas to the engine from a supply line to increase engine power and releasing working gas from the engine to an outlet line to decrease engine power, a plurality of tanks for supplying gas stored therein to the supply line, each tank being at a different pressure, a plurality of compressor units each having an inlet that is connected to the engine outlet for pumping released gas from said engine and a discharge that is connected to the supply line to return the released gas to one of said tanks, a first selector means for opening a selected one of the tanks to the supply line whereby gas can be added to the engine from the open tank or returned to the open tank from the compressor means, and a second selector means for activating at least one of the compressor units to pump gas from the engine and return said gas to a selected one of said tanks.

2. The apparatus of claim 1 that further includes a control means for sensing the engine pressure and controlling said first and second selector means in response thereto.

3. The apparatus of claim 1 wherein each compressor unit has a different capacity.

4. The apparatus of claim 3 wherein the smallest capacity compressor unit is capable of efficiently pumping the engine down to a desired minimum idle pressure.

5. The apparatus of claim 4 wherein the combined capacity of all the compressor units is capable of efficiently pumping the engine down at a desired maximum engine pressure.

6. The apparatus of claim 5 wherein the second selector means is arranged to decrease the combined compressor capacity in steps as the engine pressure is decreased from said maximum engine pressure to said minimum 1 lb. pressure.

7. Apparatus for controlling the operation of a hot gas engine that includes a hot gas engine having a positionable power controller for admitting working gas to the engine from a supply to increase engine power and releasing working gas from the engine to decrease engine power, a plurality of supply tanks for supplying gas stored therein to the engine through said supply line, each tank being at a different pressure, a compressor having a plurality of compressing chambers, each chamber having a different volume, a suction line connected to the inlet line and a discharge line connected to the supply line, a first valve means for selectively opening one of the tanks to the supply line whereby the selected tank can provide gas to the engine or receive gas from the compressor, and a second valve means for selectively opening at least one of the compressor discharge lines to the supply line whereby the capacity of the compressor can be varied.

8. The apparatus of claim 7 that further includes a control means for sensing the engine pressure and sequencing the first and second valve means to attain optimum engine efficiency.

9. The apparatus of claim 7 wherein said second valve means includes a bypass line connected between the suction line and the discharge line of each chamber, and a solenoid actuated valve in the bypass line that is actionable to open and close the bypass line whereby each chamber can be selectively placed in communication with the supply line.

10. The apparatus of claim 7 that further includes a first high pressure tank and a second low pressure tank and a solenoid actuated control valve connected to each tank whereby a selected tank can be opened to the supply line.

11. The apparatus of claim 9 wherein each discharge line has a check valve between the supply line and the bypass line to prevent gas from the tanks moving toward the compressor.

12. The apparatus of claim 10 wherein the high pressure tank is maintained at a pressure about equal to the maximum engine pressure and the low pressure tank is maintained at a pressure of about one half that of the high pressure tank.

13. The method of controlling the operation of a hot gas engine that includes the steps of connecting a plurality of supply tanks to the gas intake of a hot gas engine, each tank containing a working gas at a different pressure, automatically selecting one of said tanks to add gas to the engine as engine power is being increased in response to engine pressure so that the selected tahk pressure is equal to or greater than the engine pressure, connecting the inlets of a plurality of compressor units to the gas outlet of the engine to pump gas from the engine as engine power is being reduced, and automatically controlling the compressor units in response to engine pressure so that total compressor capacity is decreased as the engine pressure is being reduced.

14. The method of claim 13 that includes the further step of connecting the compressor units to the engine whereby engine power is used to drive said units.

15. The method of claim 13 that includes the further step of connecting the discharge of each compressor unit to the supply tanks whereby gas discharged from the compressor units can be returned to the tanks.

16. The method of claim 15 that includes the further step of shunting the discharge gas from selected compressor units back to the inlet of the compressor unit to decrease the total compressor capacity as the engine pressure is being reduced.

17. The method of claim 13 that includes the further step of matching the capacity of the smallest compressor unit to the minimum desired engine pressure.

18. The method of claim 17 that includes the further step of matching the combined capacity of the compressor units to the maximum desired engine pressure.

19. The method of claim 15 that includes the further step of controlling the return of discharge gas to the tanks so that each tank is filled to a predetermined pressure.

* * * * *

UNITED STATES PATENT AND TRADEMARK OFFICE

CERTIFICATE OF CORRECTION

PATENT NO. : 4,601,171

DATED : July 22, 1986

INVENTOR(S) : Robert E. Stotts

It is certified that error appears in the above-identified patent and that said Letters Patent are hereby corrected as shown below:

Column 4, line 15, change "26∝29" to --26-29--.

Column 12, line 8, change "tahk" to --tank--.

Signed and Sealed this

Eighth Day of September, 1987

*Attest:*

DONALD J. QUIGG

*Attesting Officer*

*Commissioner of Patents and Trademarks*